United States Patent [19]

Colvin

[11] 4,366,733

[45] Jan. 4, 1983

[54] SOCKET INCLUDING ADJUSTABLE JAWS

[76] Inventor: David S. Colvin, 31324 Burbank, Farmington Hills, Mich. 48018

[21] Appl. No.: 239,263

[22] Filed: Mar. 2, 1981

[51] Int. Cl.[3] ..... B25B 13/12

[52] U.S. Cl. ..... 81/128; 279/65; 279/74

[58] Field of Search ..... 81/53, 53.2, 128; 279/1 F, 65, 74, 114, 122

[56] References Cited

U.S. PATENT DOCUMENTS

| | | | |
|---|---|---|---|
| 810,288 | 1/1906 | Le May . | |
| 1,288,154 | 12/1918 | Palmgren . | |
| 1,498,040 | 6/1924 | Johnson . | |
| 1,554,963 | 9/1925 | Fisher . | |
| 2,500,491 | 3/1950 | Hampton | 279/65 X |
| 2,580,247 | 12/1951 | Secondi et al. . | |
| 2,582,444 | 1/1952 | Lucht . | |
| 2,669,896 | 2/1954 | Clough . | |
| 2,694,329 | 11/1954 | Thompson et al. | 81/128 X |
| 2,701,489 | 2/1955 | Osborn . | |
| 2,850,931 | 9/1958 | Conway . | |
| 2,884,826 | 5/1959 | Bruhn . | |
| 2,931,660 | 4/1960 | Barwinkel | 279/65 X |
| 3,724,299 | 4/1973 | Nelson . | |
| 4,213,355 | 7/1980 | Colvin | 81/128 |

*Primary Examiner*—James G. Smith

*Attorney, Agent, or Firm*—Reising, Ethington, Barnard, Perry & Brooks

[57] ABSTRACT

A socket (10) for torquing nuts and bolt heads includes adjustable jaws (18) biased in an outward radial direction by associated helical springs (22) whose inner ends are engaged with a seat preferably embodied by a ball (20). A support member (16) includes slideways (30) that mount slides (24) of the jaws (18) for inward and outward adjusting movement, and each jaw (18) has an inwardly facing engagement surface inclined with a slight inward inclination in an axial direction away from the slide thereof so as to accommodate for clearance between the slide and the associated slideway by jaw tilting that permits gripping of a nut or bolt head with surface-to-surface contact. A camming surface (36) on each jaw is engaged by a camming surface (44) on a sleeve (38) of the socket and defines an angle greater than 90° with the path of jaw movement so as to facilitate jaw adjustment and prevent any binding of the jaws during such adjustment.

13 Claims, 15 Drawing Figures

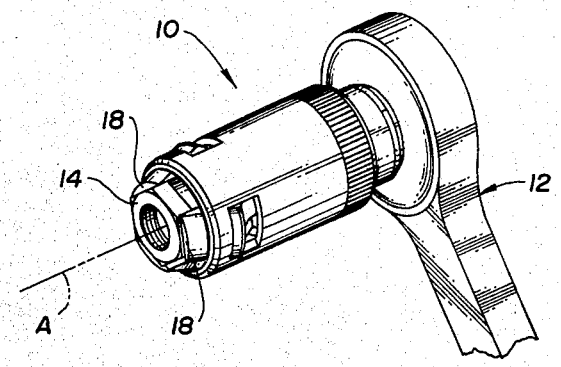
Fig. 1
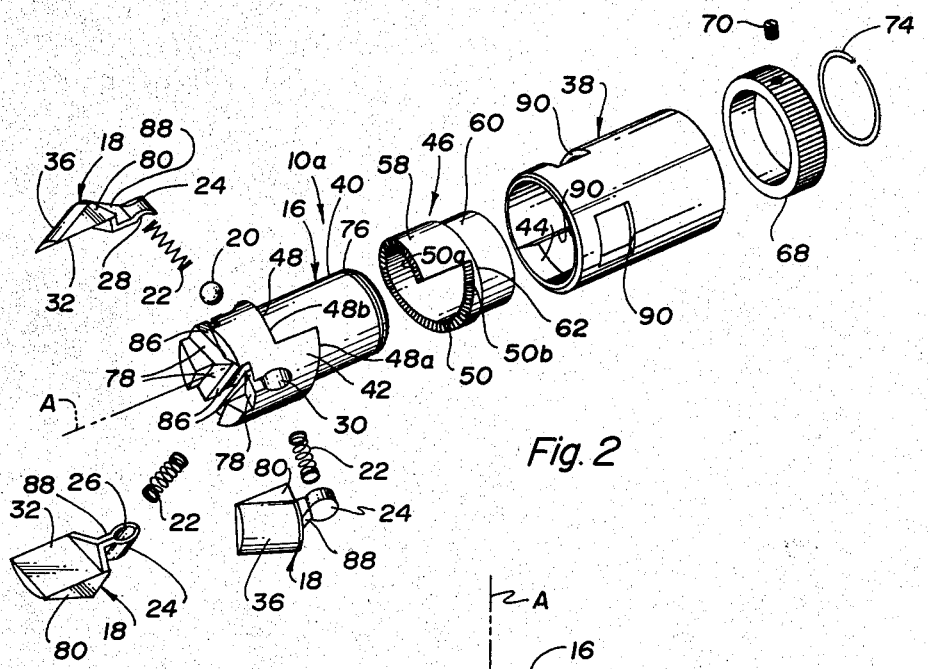
Fig. 2
Fig. 3

SOCKET INCLUDING ADJUSTABLE JAWS

TECHNICAL FIELD

This invention relates to a socket including jaws that are adjustable inwardly and outwardly in a radial direction with respect to a rotational axis of the socket so as to permit gripping and rotational driving of nuts and bolt heads of different sizes.

BACKGROUND ART

U.S. Pat. No. 4,213,355 discloses an improved adjustable socket having jaws that are mounted for radial movement with respect to a rotational axis of the socket so as to permit gripping and driving of nuts and bolt heads of different sizes. A driver or jaw support member of this socket mounts the jaws for the radial movement and is received within a sleeve that engages the jaws to prevent outward radial movement of the jaws. Axial movement of the sleeve with respect to the jaw support member adjusts the jaws inwardly and outwardly in cooperation with a spring. A mounting end of the spring is secured to the jaw support member and legs of the spring respectively engage the jaws to provide outward biasing thereof into engagement with the sleeve. In one embodiment, a helical locking surface on the jaw support member is engaged by a helical locking surface on a rotatable adjuster to fix the rotational position therebetween in a manner that axially locates the sleeve to lock the jaws in any adjusted position. In another embodiment, a helical locking surface on the jaw support member and a helical locking surface on the sleeve are engaged with each other to axially position the sleeve and thereby axially fix the jaws in any adjusted position.

Other adjustable sockets and the like are disclosed by U.S. Pat. Nos. 810,288; 1,288,154; 1,498,040; 1,554,963; 2,580,247; 2,582,444; 2,669,896; 2,701,489; 2,850,931; 2,884,826; and 3,724,299.

DISCLOSURE OF INVENTION

An object of the present invention is to provide an adjustable socket including an improved adjustment mechanism for radially adjusting jaws of the socket.

In carrying out the above object, an adjustable socket embodying the invention includes a jaw support member having a rotational axis about which the socket is rotatively driven and a plurality of jaws mounted on the support member for radial adjusting movement inwardly and outwardly with respect to the rotational axis. An adjustment mechanism for radially positioning the jaws includes a seat positioned along the rotational axis and a plurality of helical springs respectively associated with the jaws. Each helical spring has an inner end engaged with the seat and an outer end engaged with the associated jaw such that the helical springs bias the jaws outwardly in a radial direction.

The spring seat preferably comprises a ball that engages the inner end of each helical spring. Each jaw includes a slide mounted for radial movement on the support member, and the slide of each jaw includes an inwardly facing opening that receives the outer end of the associated helical spring. Each jaw slide includes an inwardly concave shape around the opening thereof in order to permit the ball to be received thereby upon inward jaw movement so as to permit farther inward movement of the jaws than would otherwise be possible.

In carrying out the above object in accordance with another aspect of the invention, the adjustable socket embodying the invention includes a jaw support member having a rotational axis about which the socket is rotatively driven and also having a plurality of slideways that extend radially from the rotational axis. A plurality of jaws respectively associated with the slideways of the support member each have a slide received by the associated slideway of the support member. The adjustment mechanism moves the jaws along the slideways radially in inward or outward directions with respect to the rotational axis to provide jaw adjustment. Each jaw has an engagement surface that faces inwardly toward the rotational axis and extends with a slight inward inclination with respect to the rotational axis in an axial direction away from the slide of the jaw. This construction allows the jaws to accommodate for clearance between the slides thereof and the associated slideways by tilting to position the engagement surfaces of the jaws in a parallel relationship with the rotational axis to grip a nut or bolt head by surface-to-surface contact.

In carrying out the above object in accordance with another aspect of the invention, the adjustable socket includes a jaw support member having a rotational axis about which the socket is rotatively driven and a plurality of slideways that extend radially from the rotational axis with an inclination in one axial direction. A plurality of jaws are respectively associated with the slideways of the support member and each has a slide received by the associated slideway of the support member such that each jaw is supported for radial movement along a path inwardly and outwardly with concomitant axial movement. Each jaw includes an inwardly facing engagement surface for applying torque during rotational driving of the socket and also includes a camming surface that extends radially with an inclination in the opposite axial direction as the support member slideways. The camming surface of each jaw defines an angle greater than 90° with respect to the path of movement thereof and the adjustment mechanism engages the camming surfaces of the jaws in a slidable relationship to provide the inward and outward adjusting movement of the jaws.

The adjustment mechanism of the socket preferably includes a sleeve that receives the jaw support member in an axially movable relationship with respect thereto in opposite directions. The sleeve includes camming surfaces that engage the jaws at the camming surfaces thereof in a slidable relationship to provide inward and outward jaw movement upon axial movement between the jaw support member and the sleeve in a corresponding axial direction. An adjuster of a sleeve shape receives the jaw support member in a rotatable relationship with respect to both the support member and the sleeve. The sleeve is movable axially upon rotation of the adjuster to thereby adjust the jaws inwardly or outwardly.

Both an adjusting ring and a retaining ring are also preferably provided with the socket. The adjusting ring is provided on the adjuster to facilitate gripping thereof for rotation that adjusts the jaws. The retaining ring is secured to the jaw support member after receipt thereof within the sleeve and within the adjuster and maintains the assembled condition of the socket.

In its preferred construction, the jaw support member has an enlarged end on which the jaws are mounted and a smaller round end that is received within the adjuster. An axial face on the enlarged end of the jaw support member includes radial grooves that respectively receive intermediate portions of the jaws. The radial grooves are respectively associated with the slideways extending parallel thereto in an axially inclined orientation. Axial slots connect the associated slideways and grooves, and each jaw has a web received within the associated axial slot and extending between the slide and intermediate portion thereof such that the slideways and grooves cooperate to mount the jaws on the enlarged end of the support member.

Economical manufacturing of the socket can be achieved by making the support member and jaws as investment castings, and for low volume production the sleeve and adjuster can also be made by investment casting or for high volume production by hot or cold tube forming or by a powdered metal process.

In one disclosed embodiment, the jaw support member and the adjuster each include a helical locking surface. Engagement of the helical locking surfaces on the support member and the adjuster adjustably positions the sleeve axially with respect to the support member and thereby adjustably positions the jaws. Each helical locking surface includes axially spaced ends so as to permit quick adjusting movement from the fully closed position of the jaws to the fully open position.

Another disclosed embodiment of the socket has the sleeve and adjuster provided with mated threads such that rotation therebetween provides axial movement of the sleeve with respect to the jaw support member for adjusting the jaws.

In both of the disclosed embodiments, the sleeve has a plurality of openings respectively adjacent and axially aligned with the camming surfaces thereof which engage the camming surfaces of the jaws. These openings receive the intermediate portions of the jaws upon opening movement so as to permit increased outward jaw movement that permits a larger fully open position than would otherwise be possible.

Except for their mutually exclusive constructions, each embodiment of the adjustable socket preferably includes all of the structural features discussed above.

Three of the jaws are preferably utilized so as to permit gripping of conventional six sided nuts and bolt heads. Of course, two or four jaws could also be used for gripping of four sided nuts and bolt heads. For special applications, any number of the jaws can be used to grip nuts or bolt heads of custom design with an unconventional number of sides.

The objects, features, and advantages of the present invention are readily apparent from the following detailed description of the best modes for carrying out the invention when taken in connection with the accompanying drawings.

BRIEF DESCRIPTION OF DRAWINGS

FIG. 1 is a perspective view illustrating an adjustable socket constructed in accordance with the invention;

FIG. 2 is an exploded perspective view of the adjustable socket illustrated in FIG. 1;

FIG. 3 is a schematic view illustrating helical locking surfaces that position jaws of the socket illustrated in FIG. 2;

BEST MODES FOR CARRYING OUT THE INVENTION

Figure 4:
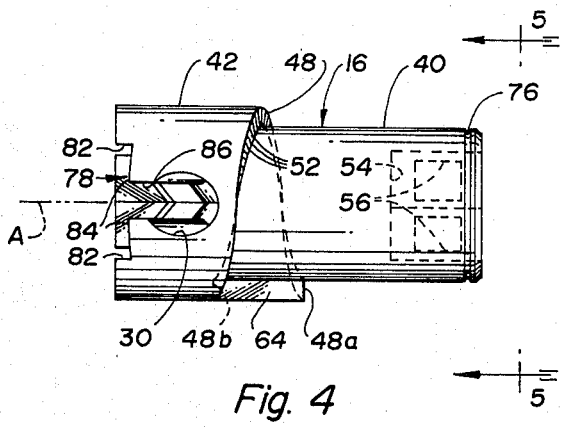
FIG. 4 is a side view of a jaw support member of the adjustable socket illustrated in FIG. 2.

Referring to FIG. 1 of the drawings, an adjustable socket constructed in accordance with the present invention is indicated generally by reference numeral 10 and is illustrated in association with a ratchet wrench 12 for providing rotational driving of the socket about a central axis A. Adjustment of the socket 10 as is hereinafter described permits gripping of a bolt head or a nut such as the nut 14 illustrated for driving rotation about axis A upon application of torque through the ratchet wrench 12.

With reference to FIG. 2, one embodiment of the adjustable socket is indicated by 10*a* and includes a jaw support member 16 having a rotational axis along the central socket axis A about which the socket is rotatively driven. Jaws 18 are mounted on the support member 16 for radial adjusting movement inwardly and outwardly with respect to the rotational axis A so as to permit gripping of bolt heads and nuts of different sizes. An adjustment mechanism for radially positioning the jaws 18 includes a seat embodied by a ball 20 and helical springs 22 respectively associated with the jaws. As seen by additional reference to FIGS. 11 and 12, the ball 20 is positioned along the rotational axis A of the jaw support member 16 and each of the helical springs 22 has an inner end engaged with the ball as well as an outer end engaged with the associated jaw 18. Helical springs 22 bias the jaws 18 outwardly in a radial direction with respect to the rotational axis A of the socket.

Figure 9:
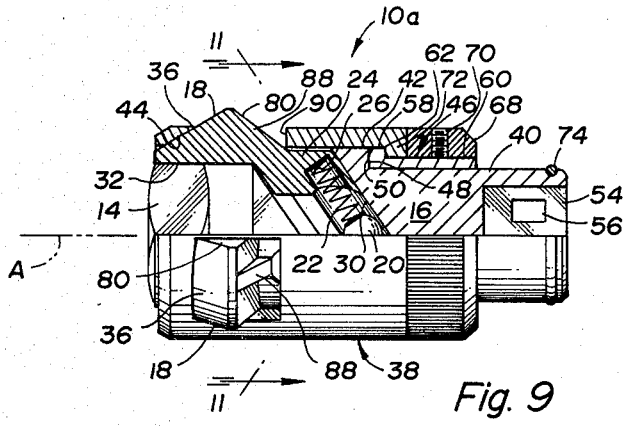
FIG. 9 is a one-half sectional view of the socket of FIG. 2 taken in a sideways direction and illustrates the jaws thereof in a fully open position.
Figure 10:
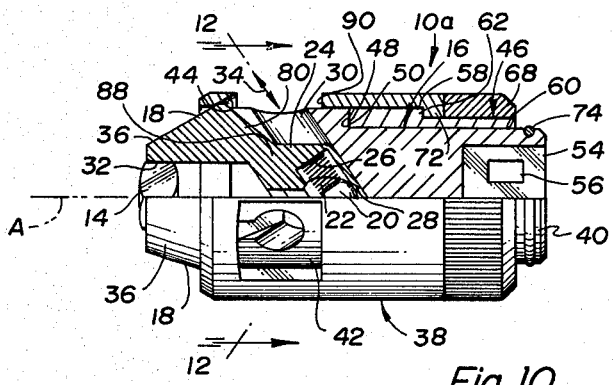
FIG. 10 is a one-half sectional view of the socket of FIG. 2 taken in a sideways direction and illustrates the jaws thereof in a fully closed position.
Figure 11:
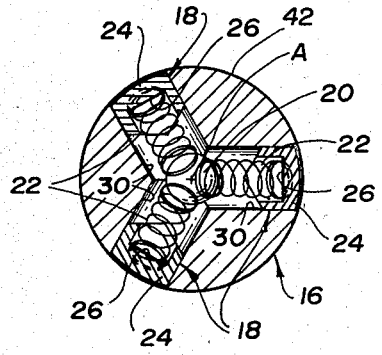
FIGS. 11 and 12 are angular cross-sectional views through the socket respectively taken along lines 11—11 and 12—12 of FIGS. 9 and 10 and illustrating helical springs that bias the jaws radially in an outward direction.
Figure 12:
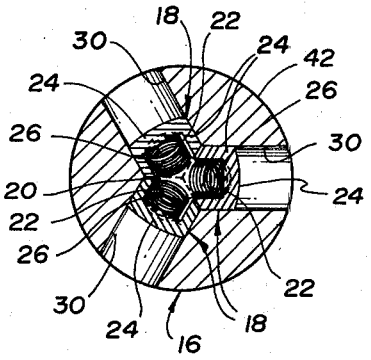

Provision of the ball 20 for seating the inner ends of the helical springs 22 provides an economical and efficient way of biasing the jaws 18 outwardly toward the fully open position as illustrated in FIGS. 9 and 11 from the fully closed position as illustrated in FIGS. 10 and 12. Each jaw 18 includes a slide 24 mounted for radial movement on the jaw support member 16 and having an inwardly facing opening 26 that receives the outer end of the associated helical spring 22. As best seen in FIG. 10, an inwardly concave shape 28 of each jaw slide 24 about the opening 26 thereof receives the ball 20 upon inward jaw movement so as to permit greater inward movement than would otherwise be possible.

Figure 8:
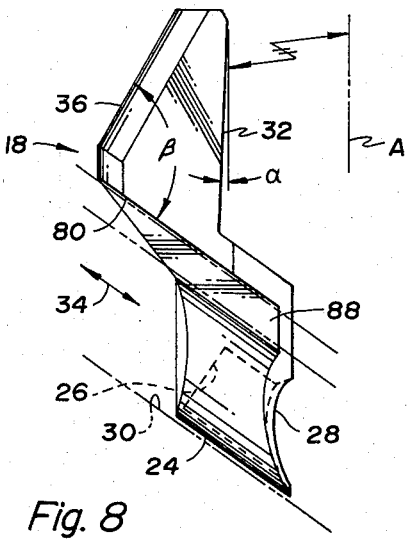
FIG. 8 is a side view of one of the jaws of the adjustable socket.

With combined reference to FIGS. 2, 8, and 9 through 12, the jaw support member 16 having the rotational axis A about which the socket is rotatively driven has slideways 30 that extend radially from the rotational axis. The jaws 18 are respectively associated with the slideways 30 with the slide 24 of each jaw received by the associated slideway of the support member. The adjustment mechanism of the socket moves the jaws 18 along the slideways 30 radially in inward or outward directions with respect to the rotational axis A upon manually actuated adjustment. As seen in FIG. 8, each jaw 18 has an engagement surface 32 that faces inwardly toward the rotational axis A and extends with a slight inward inclination with respect to the rotational axis in an axial direction away from the slide 24 as illustrated by angle $\alpha$ which is preferably on the order of about 2°. Such an inclination of each jaw engagement surface 32 allows the jaws to accommodate for clearance between the slides 24 thereof and the associated slideways 30 by tilting outwardly about the slide. This tilting of the jaws positions the engagement surfaces thereof in a parallel relationship with the rotational axis for gripping of a nut or bolt head by surface-to-surface contact. The inclination of each jaw engagement surface 32 allows the jaw slide 24 and support member slideway 30 to have an accummulated clearance on the order of about fifteen-thousandths of an inch and still function effectively in gripping with a surface-to-surface contact during transmission of torque without requiring more expensive manufacturing operations to hold closer tolerances for the jaw slides and the support member slideways.

With combined reference to FIGS. 2, 8 and 10, the jaw support member 16 which is driven about the rotational axis A of the socket has the slideways 30 thereof extending radially from the rotational axis with an inclination in one axial direction toward the socket end at which the jaw gripping takes place. Each jaw 18 has its slide 24 received by the associated slideway 30 of the jaw support member 16 for radial movement along a path inwardly and outwardly with concomitant axial movement as illustrated by arrows 34 in FIGS. 8 and 10. Each jaw 18 includes an inwardly facing engagement surface 32 for applying torque during rotational driving of the socket as previously discussed and also includes a camming surface 36 that extends radially with an inclination in the opposite axial direction as the support member slideways 32. The camming surface 36 of each jaw 18 and the path of jaw movement as illustrated by arrows 34 define an angle $\beta$ (FIG. 8) greater than 90° and preferably on the order of about 95°. The adjustment mechanism of the socket engages the jaw camming surfaces 36 in a manner which is hereinafter described and the angular relationship thereof with respect to the path of jaw movement as illustrated by arrows 34 prevents any binding during both inward and outward jaw movement. Along the path of jaw movement, both the jaw slide 24 and the support member slideway 30 preferably have round cross sections so as to also facilitate the adjusting movement of jaws 18. At their inner ends, the slideways 30 define a somewhat pointed junction with each other for receiving the ball 20 that seats the biasing springs 22.

As seen in FIGS. 2, 9, and 10, the adjustment mechanism of the socket 10 includes a sleeve 38 that receives the jaw support member 16 by insertion of a small round end 40 thereof into the sleeve followed by insertion of an enlarged end 42 thereof on which the jaw slideways 30 are provided. The sleeve includes camming surfaces 44 that engage the camming surfaces 36 of the jaws 18 as illustrated in FIGS. 9 and 10 in a slidable relationship to provide inward and outward jaw movement upon axial movement between the jaw support member 16 and the sleeve. An adjuster 46 of the socket adjustment mechanism has a sleeve type construction as best seen in FIG. 2 and receives the round end 40 of the jaw support member 16 in a rotatable relationship with respect thereto and with respect to the sleeve 38. The sleeve 38 is moved axially upon rotation of the adjuster 46 to thereby adjust the jaws inwardly or outwardly.

As seen in FIGS. 4, 5, 6, and 7, the jaw support member 16 includes a helical locking surface 48 and the adjuster 46 includes a complementary helical locking surface 50. Each of these helical locking surfaces extends about the axis of socket rotation for 360° as illustrated in FIG. 3 and includes suitable locking projections 52 such that axial engagement of the locking surfaces prevents undesired rotation between the jaw support member 16 and the adjuster 46. The locking surface 48 on the jaw support member 16 faces away from its enlarged end 42 as illustrated in FIG. 4 toward its smaller round end 40 whose axial extremity is provided with a square driving hole 54 with sides that are each provided with an associated depression 56 for receiving a ball detent on the driver of an associated wrench. Adjuster 46 has an enlarged end 58 on which its helical locking surface 50 is disposed so as to face toward the helical locking surface 48 of the jaw support member with the smaller round end 40 thereof received within the adjuster. A small end 60 of the adjuster 46 extends away from an annular shoulder 62 that faces in the opposite axial direction as the locking surface 50 on the enlarged end 58. Helical locking surface 48 on the jaw support member 16 has axially spaced ends 48*a* and 48*b* connected by an axially extending surface 64, and the helical locking surface 50 on the adjuster 46 has axially spaced ends 50*a* and 50*b* connected by an axially extending surface 66.

Figure 5:
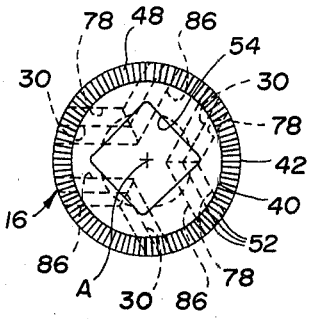
FIG. 5 is an axial end view of the jaw support member taken along line 5—5 of FIG. 4.
Figure 6:
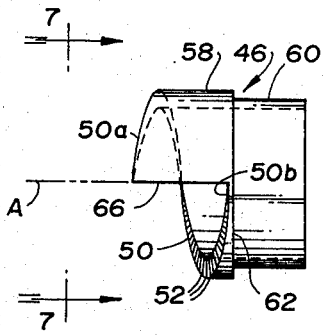
FIG. 6 is a side view of an adjuster of the adjustable socket illustrated in FIG. 2.
Figure 7:
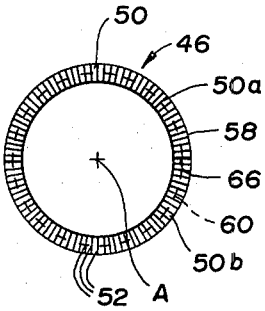
FIG. 7 is an axial end view of the adjuster taken along line 7—7 of FIG. 6.

Upon assembly of the socket, the adjuster 46 illustrated in FIGS. 6 and 7 receives the small end 40 of the jaw support member 16 illustrated in FIGS. 4 and 5 for insertion of both into the sleeve 38 illustrated in FIG. 2 with the jaws 18 received by the associated slideways 30 of the jaw support member in association with the seated springs 22 as previously described. The adjustment mechanism also includes an adjusting ring 68 that receives the smaller end 60 of the adjuster 46 after being received within the sleeve 38 and a lock screw 70 fixes the adjusting ring with respect to the adjuster. The adjusting ring has a larger diameter than the small end 60 of the adjuster 46 and thereby facilitates manual gripping and rotation of the adjuster 46 with respect to the jaw support member 16 in order to position the helical locking surfaces 48 and 50 to adjust the axial position of the sleeve 38 and thereby radially adjust the jaws.

Helical springs 22 bias the jaws 18 outwardly away from the fully closed position illustrated in FIG. 10 toward the fully open position illustrated in FIG. 9 and the consequent sliding action between the jaw camming surfaces 36 and the sleeve camming surfaces 44 biases the sleeve 38 axially toward the left so as to engage an inwardly extending annular flange 72 on the sleeve with the annular shoulder 62 on the adjuster 46. This biasing also axially engages the helical locking surfaces 48 and 50 so as to prevent rotation between the adjuster 46 and the jaw support member 16 such that the sleeve 38 is axially positioned to thereby adjustably fix the jaws in a locked relationship. Adjusting ring 68 is manually gripped with one hand and relative rotation thereof with respect to the sleeve 38 provides the adjustment of the jaws. Rotation of the ring 68 adjusts the rotational position at which the helical locking surface 50 thereof engages the helical locking surface 48 on the jaw support member 16 in order to axially adjust the position of the adjuster shoulder 62 and thereby adjust the position of the sleeve shoulder 72 such that the sleeve and jaw camming surfaces 44 and 36 adjustably position the jaws 18 in cooperation with the helical springs 22. Rotation of the adjusting ring for closing of the jaws moves the sleeve 38 toward the right with respect to the jaw support member 16 until the fully closed position is reached whereupon continued rotation moves the ends 48*a* and 50*a* of the locking surfaces past each other such that the sleeve moves axially under the spring bias to provide quick opening movement of the jaws.

Jaw support member 16 can be moved axially with respect to the sleeve 38 toward the left as illustrated in FIGS. 9 and 10. The socket includes a retaining ring 74 that is received by a round groove 76 (FIG. 4) in the small round end 40 of the jaw support member 16 after the assembly of the socket. Retaining ring 74 axially engages the small end 60 of the adjuster 46 to limit the relative axial movement of the jaw support member and thereby maintains the assembled condition of the socket.

A very economical socket can be manufactured by making the support member 16 and jaws 18 as investment castings, and for low volume production the sleeve 38 and adjuster 46 can also be made by investment casting or for high volume production by hot or cold tube forming or by a powdered metal process.

As seen in FIGS. 2, 4, 5, 8, and 9, the enlarged end 42 of the jaw support member 16 has an axial face including radial grooves 78 that extend with an angular inclination parallel to the slideways 30 and slidably support intermediate jaw portions 80 in cooperation with the slides 24 and the associated slideways. Each groove 78 has side surfaces 82 as seen in FIG. 4 as well as inclined axial surfaces 84 respectively adjacent the side surfaces. Each slideway 32 and its associated groove 78 are axially aligned and connected by an associated axial slot 86 as best seen in FIG. 4 and each jaw has an angular intermediate web 88 that is received by the associated axial slot. The support member grooves 78 and intermediate jaw portion 80 cooperate with the slides 24 and slideways 32 to provide support of the jaws in any adjusted position. Also, openings 90 in the sleeve 38 respectively adjacent the camming surfaces 44 in axial alignment therewith allow the intermediate jaw portions 80 to move outwardly through the sleeve upon outward jaw movement so as to permit a larger size fully open position than would otherwise be possible. Each jaw web 88 has an inwardly facing pointed shape as best seen in FIGS. 11 and 12 such that the jaws can move inwardly to provide a smaller fully closed position than would otherwise be possible.

Figure 13:
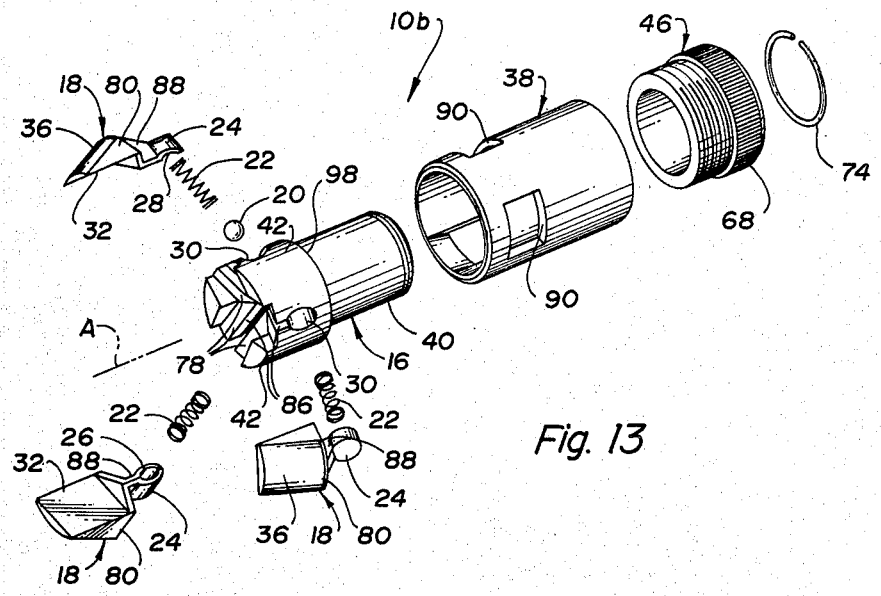
FIG. 13 is an exploded perspective view of another embodiment of the adjustable socket.
Figure 14:
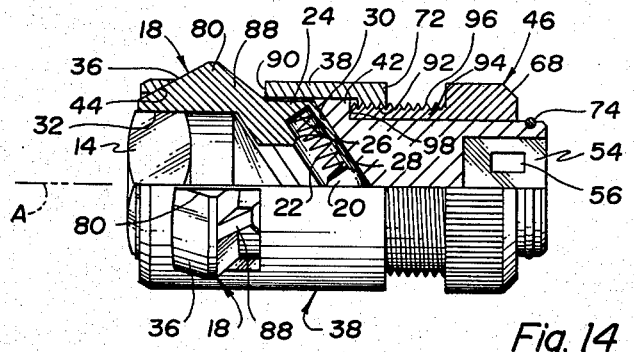
FIGS. 14 and 15 are one-half sectional views of the socket of FIG. 13 taken in a sideways direction and respectively illustrating the jaws in fully open and fully closed positions.
Figure 15:
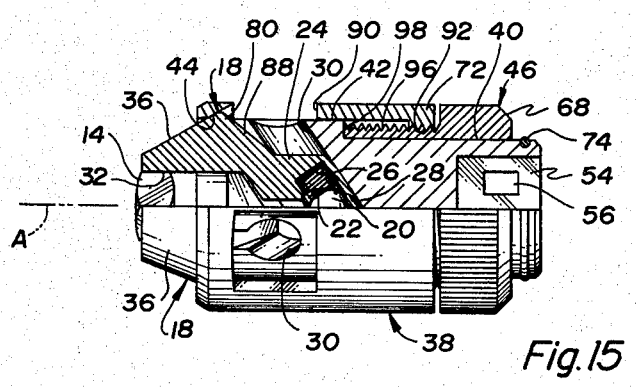

With reference to FIGS. 13, 14, and 15, another embodiment of the adjustable socket indicated at 10*b* is the same as the previously described embodiment except as will be noted such that like reference numerals are shown and much of the previous description is applicable and thus will not be repeated. Adjustable socket 10*b* has a sleeve 38 whose flange 72 includes internal threads 92 and also has an adjuster 46 having a sleeve end 94 including external threads 96 that mate with the internal threads on the sleeve. An annular shoulder 98 of the jaw support member 16 faces away from the enlarged end 42 thereof toward the smaller round end 40 and engages the axial end of the adjuster sleeve 94 under the bias of springs 22 in the assembled condition of the socket. Adjusting ring 68 is unitary with the adjuster 46 to facilitate gripping thereof and rotation of the adjuster with respect to the sleeve 38 and the jaw support member 16 so as to move the sleeve axially and thereby adjustably position the jaws 18. Rotation of the adjuster 46 in one direction moves the sleeves 38 toward the right such that the camming surfaces 36 and 44 move the jaws 18 against the bias of springs 22 in an inward direction away from the fully open position shown in FIG. 14 toward the fully closed position shown in FIG. 15. Rotation of the adjuster 46 in the opposite direction moves the sleeves 38 toward the left such that the cooperation of the camming surfaces 36 and 44 and the bias of the springs 22 moves the jaws in a direction from the fully closed position toward the fully open position.

Both embodiments of the socket are illustrated with three jaws 18 spaced circumferentially from each other at 120° positions so as to permit gripping and torquing of six sided nuts and bolt heads.

While the best modes for carrying out the invention have been described in detail, those familiar with the art to which this invention relates will reconize various alternative designs and embodiment for practicing the invention as defined by the following claims.

What is claimed is:

1. An adjustable socket comprising: a jaw support member having a rotational axis about which the socket is rotatively driven; said support member having a plurality of slideways that extend radially from the rotational axis thereof; a plurality of jaws respectively associated with the slideways of the support member; each jaw having a slide received by the associated slideway of the support member; an adjustment mechanism for moving the jaws along the slideways radially in inward or outward directions with respect to the rotational axis; each jaw having an engagement surface for gripping a nut or bolt head; and each engagement surface facing inwardly toward the rotational axis and extending with a slight inward inclination with respect to the rotational axis in an axial direction away from the slide of the associated jaw, whereby the jaws can accommodate for clearance between the slides thereof and the associated slideways by tilting to position the engagement surfaces thereof in a parallel relationship with the rotational axis to grip a nut or bolt head by surface-to-surface contact.

2. An adjustable socket comprising: a jaw support member having a rotational axis about which the socket is rotatively driven; said support member having a plurality of slideways that extend radially from the rotational axis with an inclination in one axial direction; a plurality of jaws respectively associated with the slideways of the support member; each jaw having a slide received by the associated slideway of the support member such that the jaw is supported for radial movement along a path inwardly and outwardly with concomitant axial movement; each jaw including an inwardly facing engagement surface for applying torque during rotational driving of the socket; each jaw also including a camming surface that extends radially with an inclination in the opposite axial direction as the support member slideways; the camming surface of each jaw defining an angle with the path of movement thereof in an inwardly facing direction toward the rotational axis; said angle being greater than 90°; and an adjustment mechanism for engaging the camming surfaces of the jaws in a slidable relationship.

3. A socket as in claim 1 or 2 wherein the adjustment mechanism includes a sleeve that receives the jaw support member in an axially movable relationship with respect thereto; said sleeve including camming surfaces that engage the jaws in a slidable relationship to provide inward and outward jaw movement upon axial movement between the jaw support member and the sleeve; an adjuster that receives the jaw support member in a rotatable relationship with respect to the support member and the sleeve; and the sleeve being moved axially upon rotation of the adjuster to thereby adjust the jaws inwardly or outwardly.

4. A socket as in claim 3 further including an adjusting ring on the adjuster for facilitating gripping thereof for rotation that adjusts the jaws.

5. A socket as in claim 3 further including a retaining ring that is secured to the jaw support member after receipt thereof within the sleeve and within the adjuster so as to maintain the assembled condition of the socket.

6. A socket as in claim 3 wherein the support member and the jaws are investment castings.

7. A socket as in claim 3 wherein the jaw support member includes radial grooves and each jaw having an intermediate portion received within an associated radial groove.

8. A socket as in claim 3 wherein the jaw support member and adjuster each include a helical locking surface; the helical locking surfaces of the support member and the adjuster being engaged with each other so as to adjustably position the sleeve axially with respect to the support member and thereby adjustably position the jaws; and each helical locking surface including axially spaced ends so as to permit quick adjusting movement from the fully closed position to the fully open position.

9. A socket as in claim 3 wherein the sleeve and adjuster include mated threads such that rotation therebetween provides axial movement of the sleeve with respect to the jaw support member for adjusting the jaws.

10. An adjustable socket comprising: a jaw support member having a rotational axis about which the socket is rotatively driven; said support member having an enlarged end including a plurality of slideways that extend radially from the rotational axis with an inclination in one axial direction; said support member also including a round end of a smaller size than the enlarged end thereof; a plurality of jaws respectively associated with the slideways of the enlarged end on the support member; each jaw having a slide received by the associated slideway of the support member such that the jaw is supported for radial movement along a path inwardly and outwardly with concomitant axial movement; each jaw including an engagement surface for gripping a nut or bolt head; each engagement surface facing inwardly toward the rotational axis and extending with a slight inward inclination with respect to the rotational axis in an axial direction away from the slide of the associated jaw such that the jaws can accommodate for clearance between the slides thereof and the associated slideways by tilting to position the engagement surfaces thereof in a parallel relationship with the rotational axis to grip a nut or bolt head by surface-to-surface contact; each jaw also including a camming surface that extends radially with an inclination in the opposite axial direction as the support member slideways; the camming surface of each jaw defining an angle with the path of movement thereof in an inwardly facing direction toward the rotational axis; said angle being greater than 90°; an adjustment mechanism for moving the jaws on the support member; said adjustment mechanism including a sleeve that receives the support member in an axially slidable relationship; said sleeve having camming surfaces respectively engaged with the camming surfaces of the jaws in a slidable relationship so as to move the jaws inwardly and outwardly upon axial movement of the sleeve with respect to the support member; an adjuster that receives the round end of the support member and is rotatable with respect thereto to move the sleeve axially with respect to the support member for adjustment of the jaws inwardly or outwardly depending upon the direction of rotation; said adjustment mechanism also including a seat positioned along said rotational axis and a plurality of helical springs respectively associated with the jaws; and each helical spring having an inner end engaged with said seat and an outer end engaged with the associated jaw such that the helical springs bias the jaws outwardly in a radial direction.

11. An adjustable socket comprising: a jaw support member having a rotational axis about which the socket is rotatively driven; said support member having an enlarged end including a plurality of slideways that extend radially from the rotational axis with an inclination in one axial direction; said enlarged end of the support member also including radial grooves respectively associated with the slideways extending parallel thereto and axial slots connecting the associated slideways and grooves; said support member also including a round end of a smaller size than the enlarged end thereof; a plurality of jaws respectively associated with the slideways of the enlarged end on the support member; each jaw having a slide received by the associated slideway of the support member and an intermediate portion received by the associated groove as well as a web received by the associated axial slot such that the jaw is supported for radial movement along a path inwardly and outwardly with concomitant axial movement; each jaw including an engagement surface for gripping a nut or bolt head; each engagement surface facing inwardly toward the rotational axis and extending with a slight inward inclination with respect to the rotational axis in an axial direction away from the slide of the associated jaw such that the jaws can accommodate for clearance between the slides thereof and the associated slideways by tilting to position the engagement surfaces thereof in a parallel relationship with the rotational axis to grip a nut or bolt head by surface-to-surface contact; each jaw also including a camming surface that extends radially with an inclination in the opposite axial direction as the support member slideways; the camming surface of each jaw defining an angle with the path of movement thereof in an inwardly facing direction toward the rotational axis; said angle being greater than 90°; an adjustment mechanism for moving the jaws on the support member; said adjustment mechanism including a sleeve that receives the support member in an axially slidable relationship; said sleeve having camming surfaces respectively engaged with the camming surfaces of the jaws in a slidable relationship so as to move the jaws inwardly and outwardly upon axial movement of the sleeve with respect to the support member; said sleeve having a plurality of openings respectively adjacent the camming surfaces thereof so as to permit increased outward movement of the jaws; an adjuster that receives the round end of the support member and is rotatable with respect thereto to move the sleeve axially with respect to the support member for adjustment of the jaws inwardly or outwardly depending upon the direction of rotation; said adjustment mechanism also including a ball positioned along said rotational axis and a plurality of helical springs respectively associated with the jaws; and each helical spring having an inner end engaged with said ball and an outer end engaged with the associated jaw such that the helical springs bias the jaws outwardly in a radial direction.

12. A socket as in claim 10 or 11 wherein the jaw support member and adjuster each include a helical locking surface; the helical locking surfaces of the support member and the adjuster being engaged with each other so as to adjustably position the sleeve axially with respect to the support member and thereby adjustably position the jaws; each helical locking surface including axially spaced ends so as to permit quick adjusting movement from the fully closed position to the fully open position; an adjusting ring on the adjuster for facilitating gripping thereof for rotation thereof with respect to the jaw support member so as to axially move the sleeve and adjust the jaws; and a retaining ring that is secured to the smaller round end of the jaw support member after the jaw support member is received within the sleeve and the adjuster so as to maintain the assembled condition of the socket.

13. A socket as in claim 10 or 11 wherein the sleeve and adjuster include mated threads such that rotation therebetween provides axial movement of the sleeve with respect to the jaw support member for adjusting the jaws; an adjusting ring on the adjuster for facilitating gripping thereof for rotation thereof with respect to the jaw support member so as to axially move the sleeve and adjust the jaws; and a retaining ring that is secured to the smaller round end of the jaw support after the jaw support member is received within the sleeve and the adjuster so as to maintain the assembled condition of the socket.

* * * * *